US006502742B1

(12) United States Patent
Su

(10) Patent No.: US 6,502,742 B1
(45) Date of Patent: Jan. 7, 2003

(54) CARD FILE ASSEMBLY

(76) Inventor: Ken-Jui Su, 180, First Shu Wang Rd., Da Li City, Taichung Hsien (TW)

( * ) Notice: Subject to any disclaimer, the term of this patent is extended or adjusted under 35 U.S.C. 154(b) by 0 days.

(21) Appl. No.: 09/994,033

(22) Filed: Nov. 23, 2001

(51) Int. Cl.[7] ..... B65D 27/00
(52) U.S. Cl. ..... 229/67.3; 229/67.4
(58) Field of Search ..... 229/67.1, 67.3, 229/67.4; 150/113; 190/110

(56) References Cited

U.S. PATENT DOCUMENTS 2,055,569 A * 9/1936 Zolotow ..... 150/113
2,316,328 A * 4/1943 Guenther et al. ..... 190/103
3,410,376 A * 11/1968 Benzel ..... 190/109
4,250,938 A * 2/1981 Siegel ..... 150/111
4,485,962 A * 12/1984 Farley ..... 229/67.1
5,275,438 A * 1/1994 Struhl ..... 206/232
5,947,279 A * 9/1999 Lee et al. ..... 206/232

* cited by examiner

*Primary Examiner*—Jes F. Pascua
(74) *Attorney, Agent, or Firm*—Alan D. Kamrath; Rider, Bennett, Egan & Arundel

(57) ABSTRACT

A card file assembly has a main card file and an auxiliary card file. The main card file has a first cover plate, a first outer casing, a plurality of first plastics separators, and a pair of first box pleat sheets. The first outer casing has a front chamber having a bevel portion. The auxiliary card file has a second cover plate, a second outer casing, a plurality of second plastics separators, and a pair of second box pleat sheets. The auxiliary card file is inserted in the front chamber of the first outer casing.

7 Claims, 7 Drawing Sheets

CARD FILE ASSEMBLY

BACKGROUND OF THE INVENTION

The present invention relates to a card file assembly. More particularly, the present invention relates to a card file assembly which combines two card files together.

A conventional card file has a predetermined size, so it cannot receive a sheet of oversized paper.

SUMMARY OF THE INVENTION

An object of the present invention is to provide a card file assembly which combines two card files together.

Accordingly, a card file assembly comprises a main card file and an auxiliary card file. The main card file has a first cover plate, a first outer casing, a plurality of first plastics separators, and a pair of first box pleat sheets. The first outer casing has a front chamber having a bevel portion. The auxiliary card file has a second cover plate, a second outer casing, a plurality of second plastics separators, and a pair of second box pleat sheets. The auxiliary card file is inserted in the front chamber of the first outer casing.

DETAILED DESCRIPTION OF THE INVENTION

Figure 1:
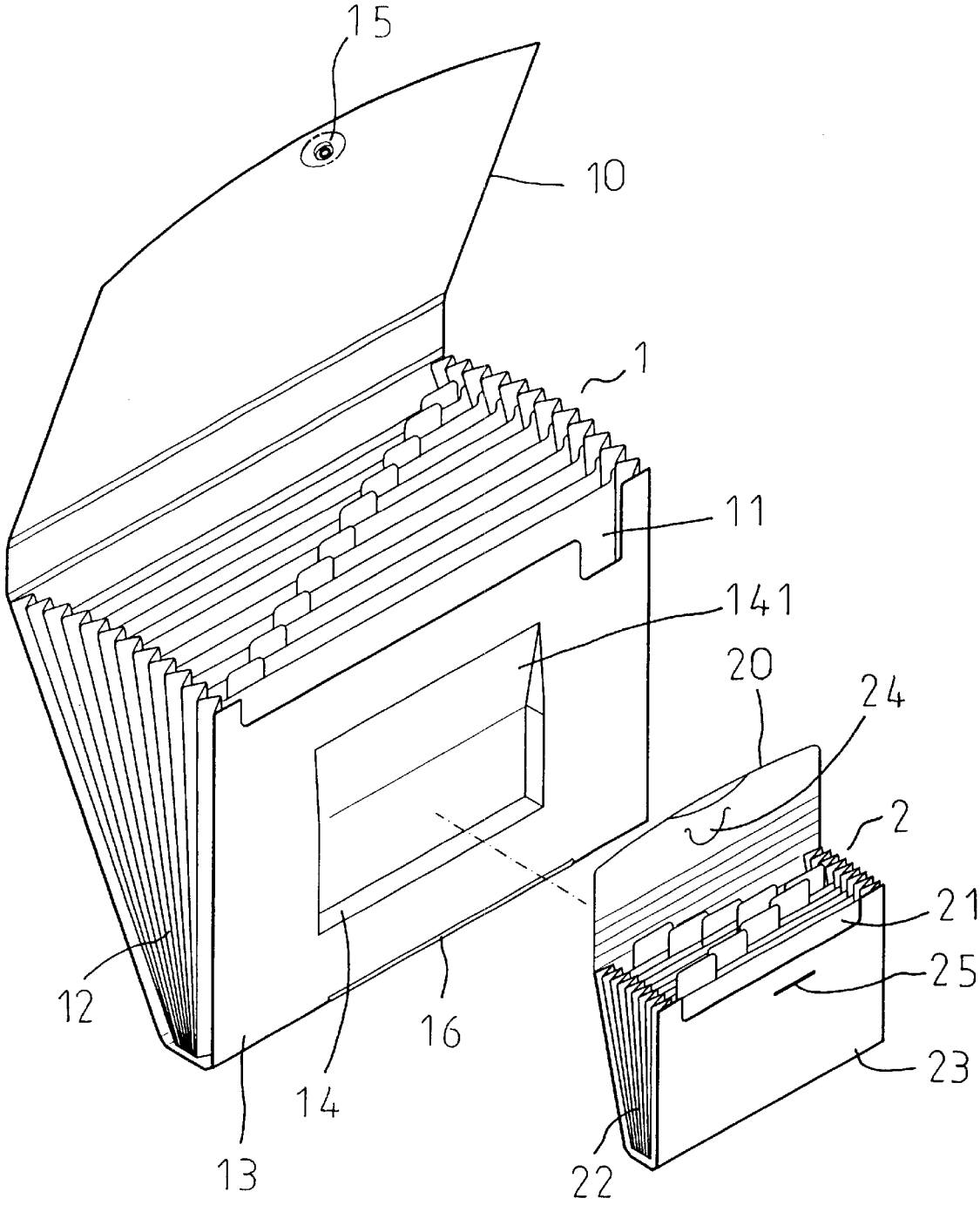
FIG. 1 is a perspective view of a card file assembly of a preferred embodiment in accordance with the present invention.
Figure 2:
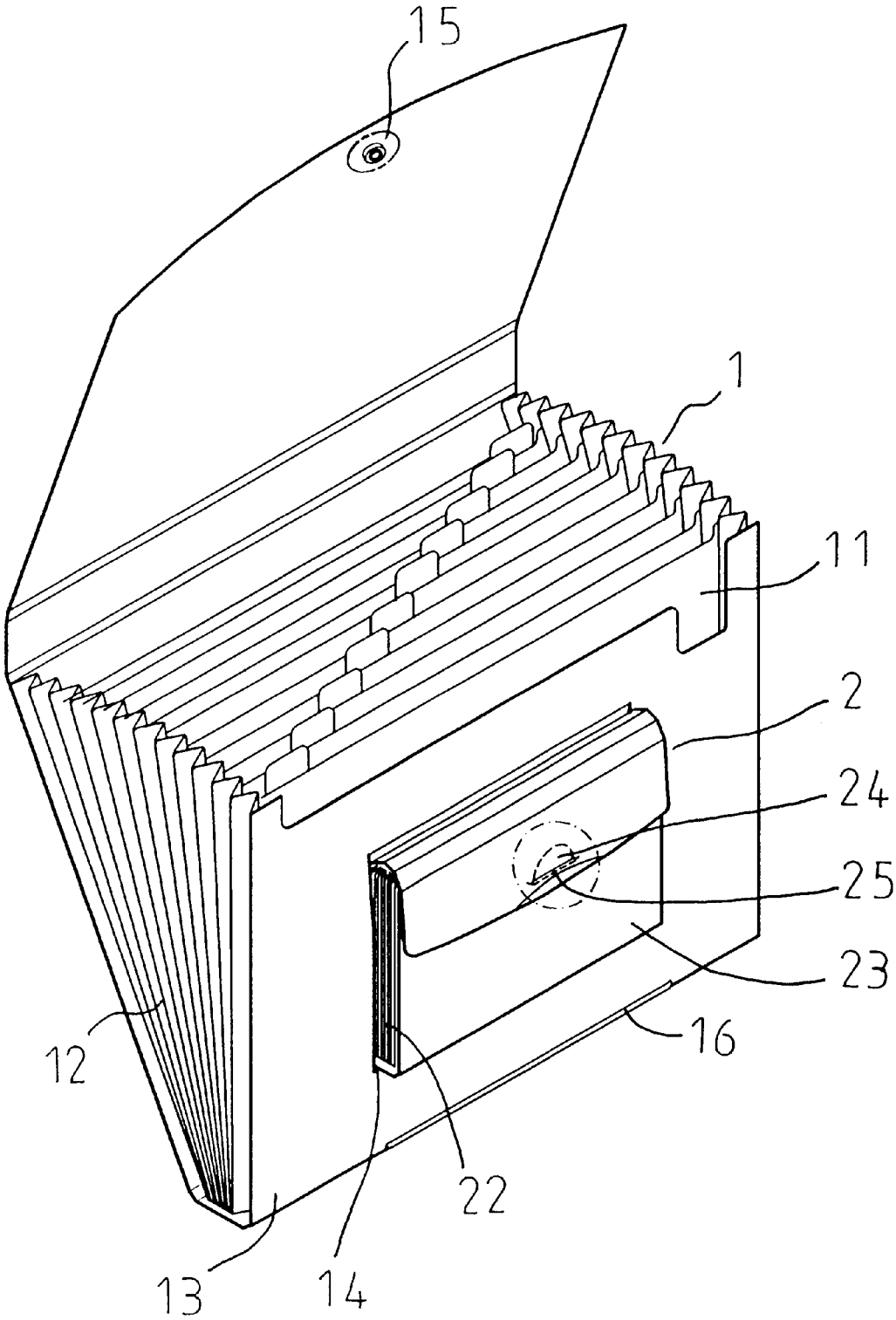
FIG. 2 is a perspective assembly view of a card file assembly of a preferred embodiment while a first cover plate of a main card file is opened and a second cover plate of an auxiliary card file is closed.
Figure 2A:
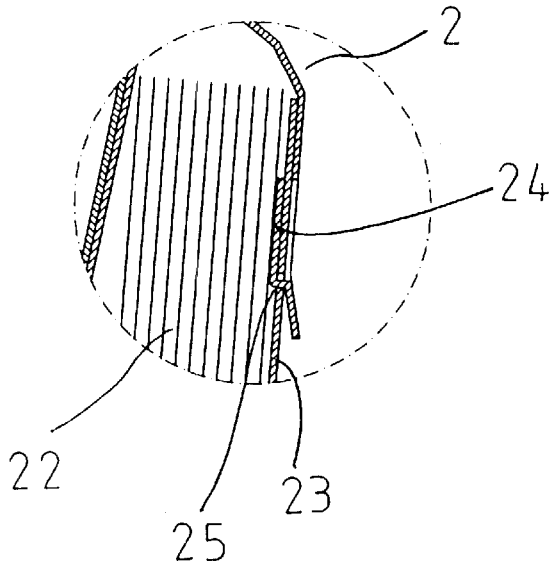
FIG. 2A is a sectional schematic view while a tongue plate of a second cover plate is inserted in a slot of a second outer casing.
Figure 4A:
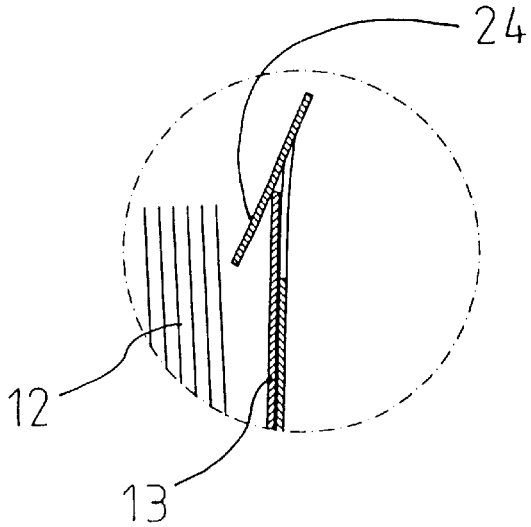
FIG. 4A is a sectional view of a tongue plate of a second cover plate.
Figure 3:
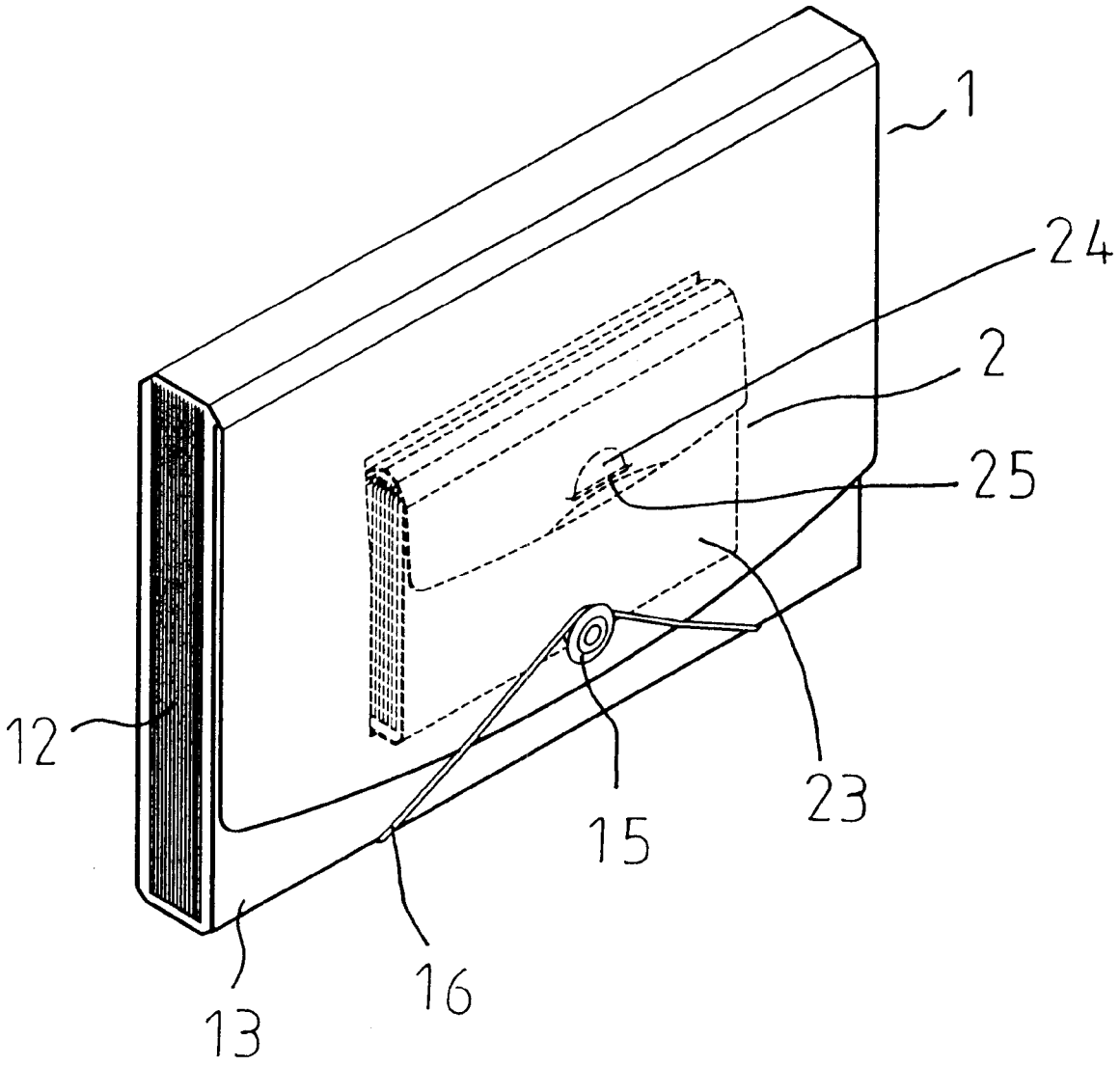
FIG. 3 is a perspective assembly view of a card file assembly of a preferred embodiment while a first cover plate of a main card file is closed and a second cover plate of an auxiliary card file is closed.
Figure 4:
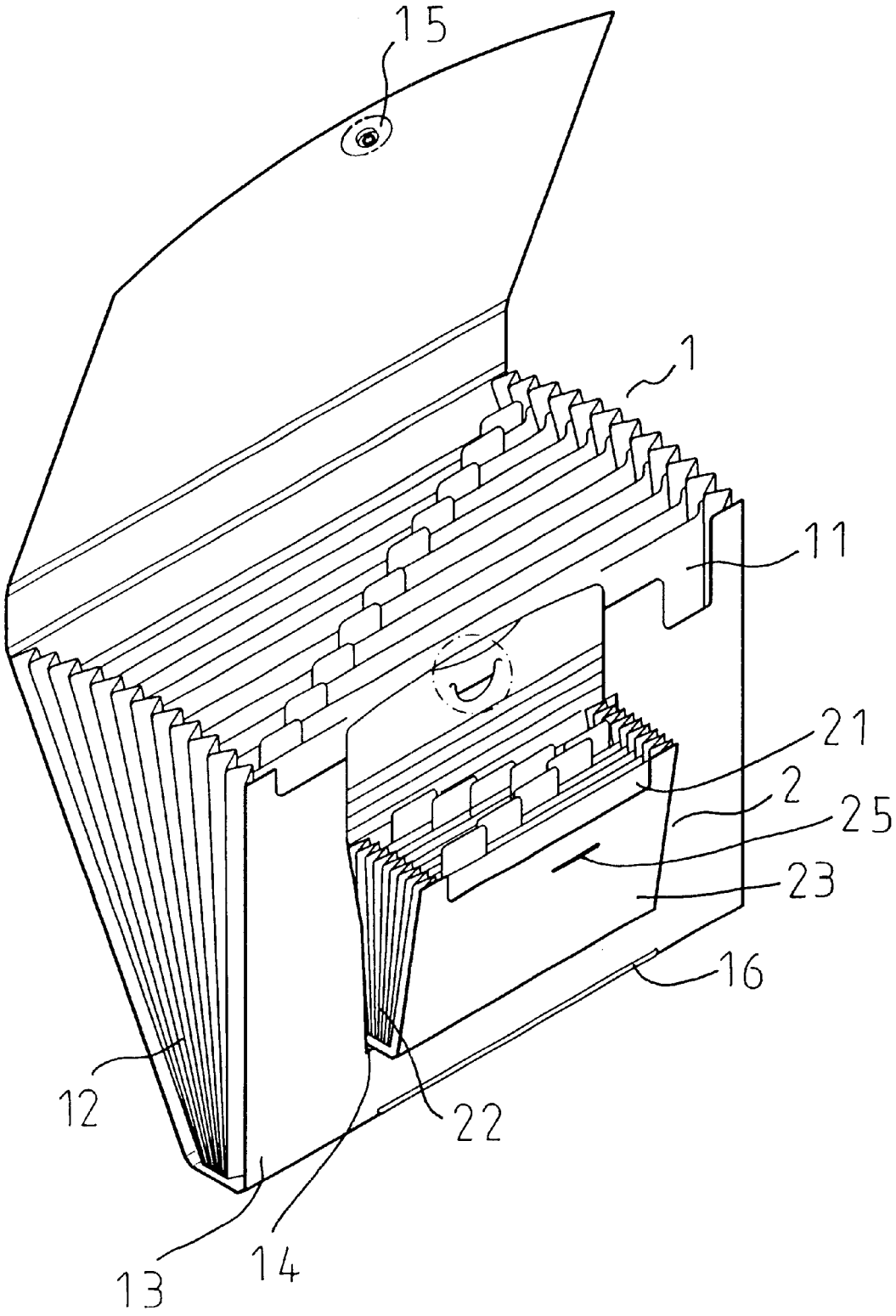
FIG. 4 is a perspective assembly view of a card file assembly of a preferred embodiment while a first cover plate of a main card file is opened and a second cover plate of an auxiliary card file is opened.
Figure 5:
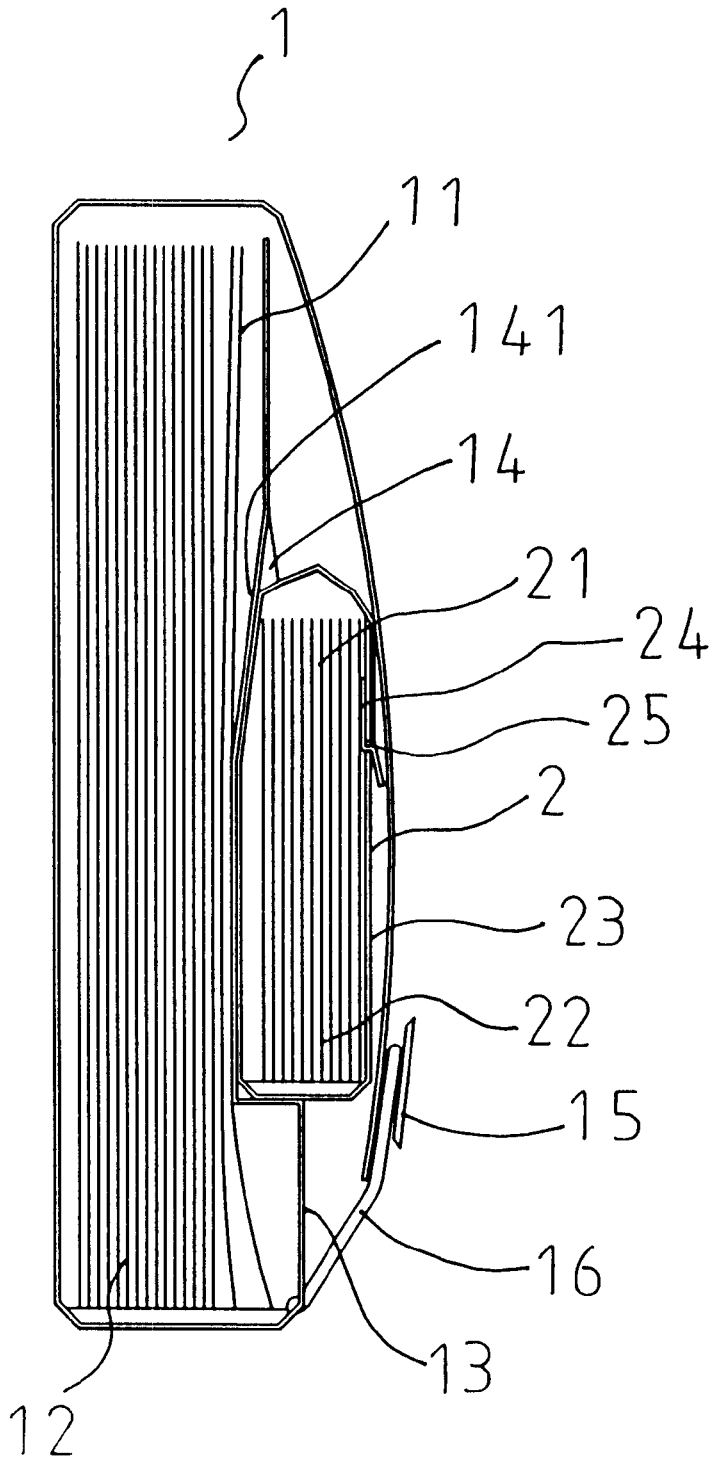
FIG. 5 is an elevational of a card file assembly of a preferred embodiment in accordance with the present invention.
Figure 6:
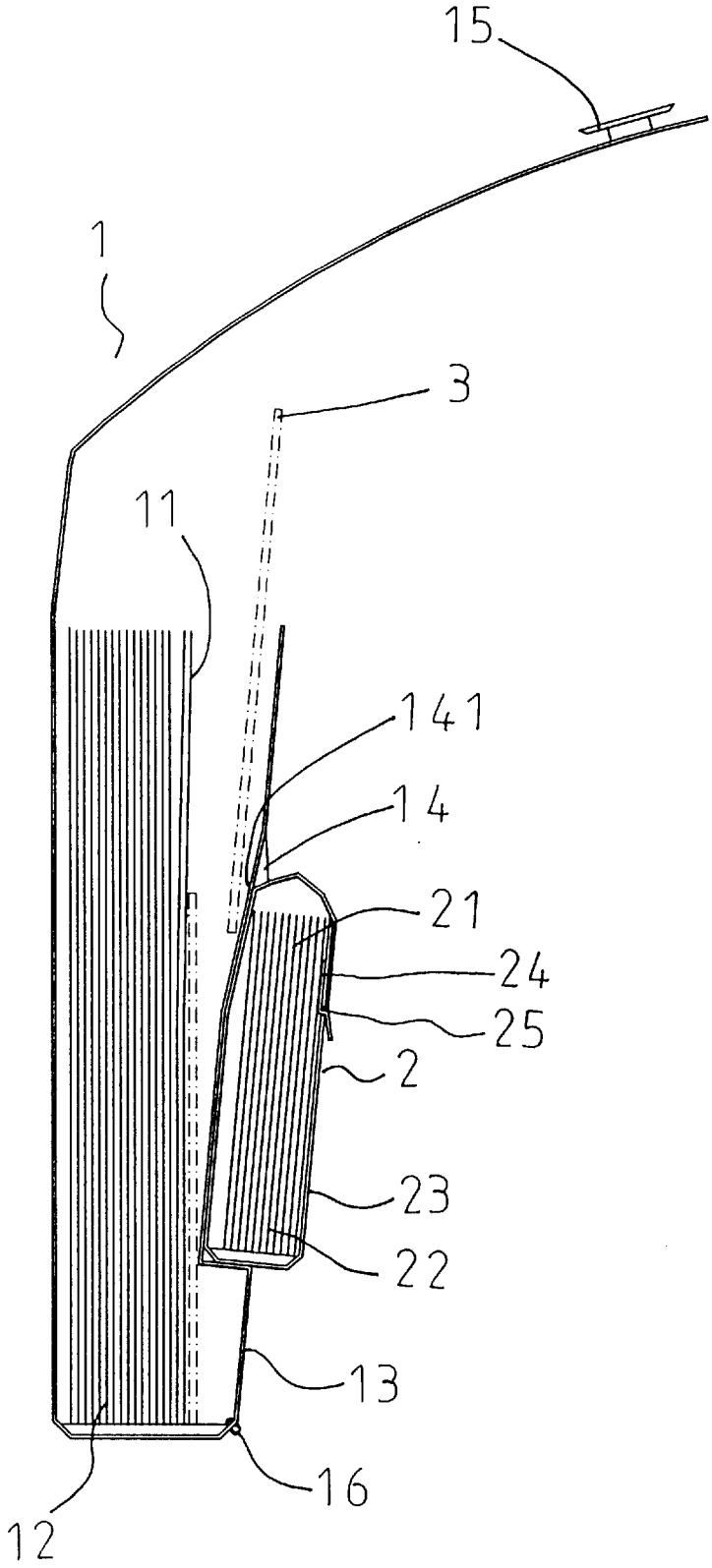
FIG. 6 is a schematic view illustrating a card file assembly of a preferred embodiment receives a sheet of paper.

Referring to FIGS. 1 to 6, a card file assembly comprises a main card file 1 and an auxiliary card file 2.

The main card file 1 has a first cover plate 10, a first outer casing 13, a plurality of first plastics separators 11, and a pair of first box pleat sheets 12.

The first outer casing 13 has a front chamber 14 having a bevel portion 141.

The auxiliary card file 2 has a second cover plate 20, a second outer casing 23, a plurality of second plastics separators 21, and a pair of second box pleat sheets 22.

The auxiliary card file 2 is inserted in the front chamber 14 of the first outer casing 13.

The main card file 1 is made of a plastics material.

The auxiliary card file 2 is made of a plastics material.

A button 15 is disposed on the first cover plate 10 of the main card file 1.

A rope 16 is disposed on a bottom of the first outer casing 13 of the main card file 1.

When the first cover plate 10 covers the main card file 1, the rope 16 surrounds the button 15.

A tongue plate 24 is disposed on the second cover plate 20 of the auxiliary card file 2.

A slot 25 is formed on the second outer casing 23 of the auxiliary card file 2.

When the second cover plate 20 covers the auxiliary card file 2, the tongue plate 24 of the second cover plate 20 is inserted in the slot 25 of the second outer casing 23 of the auxiliary card file 2.

When the second cover plate 20 is opened, the tongue plate 24 of the second cover plate 20 engages with a top portion of the first outer casing 13 of the main card file 1.

The present invention is not limited to the above embodiment but various modification thereof may be made. Furthermore, various changes in form and detail may be made without departing from the scope of the present invention.

I claim:

1. A card file assembly comprises:

a main card file and an auxiliary card file, the main card file having a first cover plate, a first outer casing, a plurality of first plastics separators, and a pair of first box pleat sheets, the first outer casing having a front chamber having a bevel portion, the auxiliary card file having a second cover plate, a second outer casing, a plurality of second plastics separators, and a pair of second box pleat sheets, and the auxiliary card file inserted in the front chamber of the first outer casing.

2. The card file assembly as claimed in claim 1, wherein the main card file is made of a plastics material.

3. The card file assembly as claimed in claim 1, wherein the auxiliary card file is made of a plastics material.

4. The card file assembly as claimed in claim 1, wherein a button is disposed on the first cover plate of the main card file.

5. The card file assembly as claimed in claim 1, wherein a rope is disposed on a bottom of the first outer casing of the main card file.

6. The card file assembly as claimed in claim 1, wherein a tongue plate is disposed on the second cover plate of the auxiliary card file.

7. The card file assembly as claimed in claim 1, wherein a slot is formed on the second outer casing of the auxiliary card file.

* * * * *